US005862824A

United States Patent [19]

Herman

[11] Patent Number: 5,862,824

[45] Date of Patent: Jan. 26, 1999

[54] MOBILITY ASSISTING DEVICE

[76] Inventor: Harry H. Herman, 3003 Van Ness St., NW., Washington, D.C. 20008

[21] Appl. No.: 841,789

[22] Filed: May 5, 1997

Related U.S. Application Data

[62] Division of Ser. No. 266,778, Jun. 29, 1994, Pat. No. 5,640,986.

[51] Int. Cl.[6] ..... A61H 3/02

[52] U.S. Cl. ..... 135/68; 135/69; 135/82

[58] Field of Search ..... 135/67–69, 71, 135/73, 82; 248/188.3

[56] References Cited

U.S. PATENT DOCUMENTS

| | | | |
|---|---|---|---|
| 3,280,831 | 10/1966 | Parker | 135/68 |
| 4,245,659 | 1/1981 | Shofner | 135/68 |
| 5,113,887 | 5/1992 | Herman | 135/68 |
| 5,217,033 | 6/1993 | Herman | 135/68 |
| 5,402,587 | 4/1995 | Buschbacher | 135/67 |
| 5,673,719 | 10/1997 | Shofner | 135/68 |

*Primary Examiner*—Lanna Mai

*Attorney, Agent, or Firm*—Roylance,Abrams,Berdo & Goodman, L.L.P.

[57] ABSTRACT

A mobility assisting device which includes a vertical support structure pivotally coupled to a substantially planar base structure. The base remains parallel to the ground as the base moves relative to the ground. The underarm support is mounted to the vertical support structure so as to be pivotal relative thereto to avoid the translation of pressure points under the patient's arms and rubbing between the upper end of the support and the underarm. The underarm support is angled relative to the plane of the device increase the comfort to the user. The base is biased perpendicular to the support structure by a resilient shock dampening pad between the support structure and the base.

10 Claims, 11 Drawing Sheets

FIG. 6
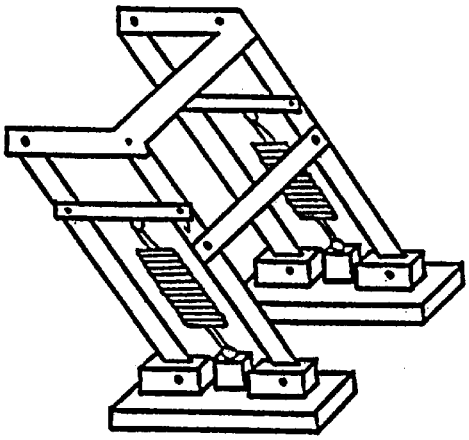
FIG. 7
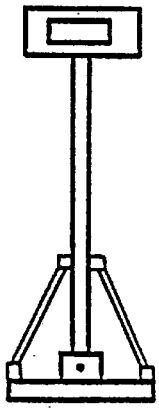
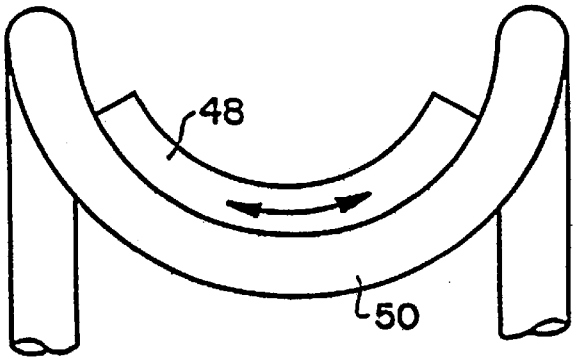
FIG. 8
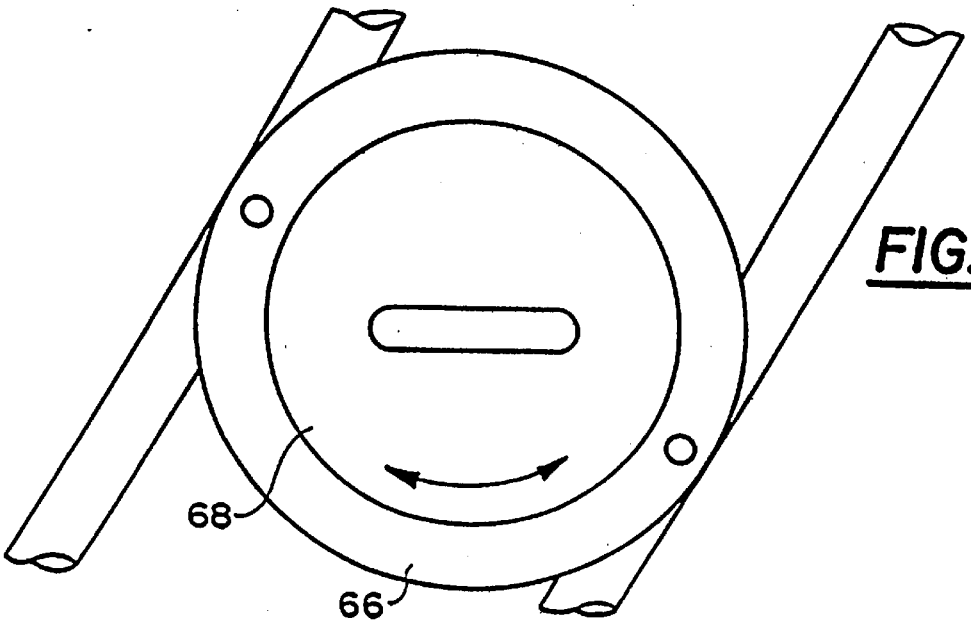
FIG. 9

MOBILITY ASSISTING DEVICE

This is a division of application Ser. No. 08/266,778 filed Jun. 29, 1994 now U.S. Pat. No. 5,640,986.

FIELD OF THE INVENTION

The present invention relates to devices for assisting the mobility of permanently or temporarily handicapped individuals and, more particularly, to an improved crutch-type, cane-type and walker-type device for assisting. walking.

BACKGROUND OF THE INVENTION

Mobility is essential to functioning independently, particularly in today's highly mobile society. Thus, mobility is of constant concern to those individuals who are incapable of walking or who are limited in their ability to walk normally. It is well established that individuals who have difficulty walking would prefer to move about on their feet if at all possible rather than in a wheel chair. Ideally devices should be provided to assist such handicapped or temporarily injured individuals to enable the ease and safety of walking as near as possible.

Crutches, walking sticks or canes, walkers and the like have been used for assisting people in walking for centuries. Typically, crutches have been in the form of an elongated member which is disposed under the arm of the user and extends to the ground so as to provide a support from under the user's arm to the walking surface. Walking sticks and walkers, on the other hand, are designed to be manually grasped by the user.

Crutches and other mobility assisting devices have been modified and improved over the years. However, they continue to be rigid devices of predetermined configuration which the user for the most part must be trained to use.

Crutches require that the user balance himself upon the tip or bottom end of the rigid support which extends from under the arm to a small tip contacting the walking surface. However, the rubber-coated tip of the crutch has a cross-sectional area of at most about 3 square inches. Thus, if the tip comes into contact with a rock, loose gravel, the edge of a curb or other uneven surface, water, or ice, the individual using the crutches can slip and fall. This is also true for canes, walkers and walking sticks.

Conventional crutches are both uncomfortable and hazardous to the user. Indeed, crutches do not ergonomically fit people in a satisfactory manner. To prevent interference with the arms and body, conventional crutches must be used at an angle of 10° off the vertical with the base tip away from the user's feet. Thus, conventional crutches cannot be correctly used in the vertical plane parallel to the user's body and they must be used so that the longitudinal axis thereof is not at a right angle to the walking surface. The angle at which the tip of the crutch contacts the ground not only from forward to rear, but also laterally, does not lend itself to proper traction. This lateral angle causes the fixed upper end of the crutch to place force against the upper ribs under the arms and the nerves in the axilla and in particular the radial nerve which can cause discomfort and injury. The forward and rear motion of the crutch and the resulting underarm motion causes abrasion by the upper end movement of a pressure point from a forward point to a rearward point under the arm as the crutches pivot relative to the ground from their forward to their rearward position. Thus, there is a tendency to place a great deal of padding to the upper end of the crutch or the user will be injured temporarily or permanently and may cease use of the crutches to alleviate the associated discomfort or injury.

Proper use of crutches require that no weight be placed on the underarm. The hands and arms are supposed to carry all the weight. Experience has shown that most users do not have sufficient arm and hand strength to accomplish this and often improperly use the crutches resulting in accidents and injuries. Due to the high rate of accidents on crutches, many care givers will not let their patients use crutches. Often a wheel chair is the only alternative option to crutches.

Crutch mobility under normal use of crutches is dependent upon the legs of the user, or one leg at least, leaving the ground and swinging forward like a pendulum to the forward point where it contacts the walking surface. The leg or foot in contact with the walking surface then acts as a fulcrum or pivot while the crutches move off the surface from the rear position to the forward position. Crutches therefore operate on the basis that the top of the crutch moves in the form of an arc with the apex in the vertical or upright position. This means that the user of a crutch must be raised then lowered by the use of the underarm rest, or by holding themselves up with their arms.

The effort required to move forward on a crutch is increased due to the need to have a force or momentum in the action sufficient to lift the user during each forward step of the crutch. This lifting force also places cyclic forces upward on the user's underarm and shoulders. When the user drops in the forward position, their feet or foot impacts the ground and can cause injury and discomfort especially to those with additional functional limitations or the elderly or frail. Furthermore, it is often the case that the user must wear a heavy cast or brace on their leg or foot. This further adds to the weight that must be raised from and lowered back to the ground.

The hand grips on conventional crutches are in a fixed position, and because of the aforementioned raising and lowering, as well as the dynamic forces under the arms, the conventional crutch user is required to utilize strength in the hands and arms to raise themselves. It is not unusual for the user to develop tired, sore or injured arms and hands.

Accordingly, despite various structural modifications and improvements, crutches remain quite difficult to use, uncomfortable and even injurious and dangerous. Thus, just at the time of pain, suffering, high anxiety, and weakness, the handicapped individual may further injure himself by use of a conventional crutch and/or sacrifice mobility out of fear of further injury and discomfort.

Canes and walking sticks also require balancing on a small rubber tip; although there has been improvement in the form of a cane which has a short four legged base, the problem remains that hazards on the walking surface could cause the cane or walking stick which have a small surface in contact with the ground to slip resulting in the user falling. In addition, the user's hand or arm grip is rigidly fixed to the cane or walking stick which can cause discomfort and possible injury or reduce the ability toward its use.

Conventional walkers have four legs, although, in use most of the time only the front two or rear two legs are in contact with the walking surface as in the case with the crutches and canes. Users are limited in conventional walkers due to their poor surface contact, especially uneven surfaces, ice, gravel, rocks, water, etc. Also, users of walkers must adapt their hands and arms to the fixed hand grip or hand holds.

As in the case with crutches, walkers, canes, and walking sticks remain hazardous and difficult for some who need help in mobility to use.

It is therefore desirable to provide devices including a crutch for assisting the mobility of injured or handicapped individuals which provide a stable base structure that is ergonomically correct, does not require much instruction to use and minimizes the likelihood of slippage on wet or icy surfaces or that an uneven or rough walking surface will inhibit the stability of the crutch structure and thereby the mobility of the individual.

It is desirable to provide a crutch-like structure that minimizes the discomfort and possible injury to the individual's hand, feet, arm or underarm during use.

SUMMARY OF THE INVENTION

The present invention has the primary object of providing devices for assisting the mobility of injured or otherwise handicapped individuals by providing a stable base structure which remains substantially parallel to and flat on the ground surface throughout motion of the individual relative to the ground.

A further objective of this invention is the novel means for maintaining the hand hold, handle, or underarm grip parallel to the ground, or rotatable, so that there is no abrasive or rubbing action, and is ergonomically suitable to the conditions of the user.

One embodiment of the present invention has the further object of providing a bearing surface for contact with the user's body that minimizes friction and abrasive action therebetween and the translation of pressure points. Thus, it is an object of the invention to provide a mobility assisting device which is ergonomically suited to the human body.

To achieve the foregoing objects, the mobility assisting device of the present invention provides a base which is articulated relative to the vertical support structure thereof so that the base remains in parallel relation to the ground as the user rests upon and/or holds the device and moves relative to the ground so that the stability of the device is maximized and the likelihood of slippage due to uneven, moist, icy or otherwise torturous terrain is minimized. Further, the invention provides a bearing surface which does not move relative to the portion of the user's anatomy which it contacts.

More particularly, the objects of the invention are achieved with a mobility assisting device which includes a vertical support structure and a substantially planar base structure mounted to the vertical support structure so as to be articulatable relative thereto. Further, a supporting structure for the user's arm is mounted to the vertical support structure so as to be pivotal relative thereto so as to avoid the translation of pressure points under the user's arms and abrasions and nerve damage due to the rubbing action between the upper end of the conventional crutch and the underarm. The vertical support structure and the base structure may have springs or actuators mounted to one another so as to be urged into a perpendicular position or urged through its cycle so as to assist user's movement with the crutches or walking sticks.

Additional features of the invention include the articulation of the base with respect to the vertical support structure of the crutch and cane system. The vertical support structure is able to pivot in a side-to-side direction as well as in a forward and backward direction to enable the base to make full contact with an inclined or uneven walking surface. The articulated connection between the support structure and the base also provides some shock dampening to increase the comfort to the user.

A further object of the invention is to provide a shock absorbing device in the vertical support structure to reduce the shock of the base striking the ground from being transferred to the user. The shock absorbing device may be in the base, vertical structure or underarm support.

To facilitate a more ergonomically designed kinematic crutch assembly, the underarm support is placed at an angle with respect to the plane of the vertical support structure. Typically, the underarm support will be about 10°–20° to the plane of the vertical support structure. In embodiments of the invention, the angle of the underarm support with respect to the vertical support may be adjustable to accommodate the needs of the particular user.

These and other objects of the invention are basically attained by a mobility assisting device comprising a substantially planar base support; a vertical support structure pivotally coupled to the base support structure; an underarm support pivotally coupled to the vertical support structure whereby, in use, the base support structure and the underarm support cross-bar element pivot relative to the vertical support structure so as to remain substantially parallel to the ground surface, the underarm support being positioned at an acute angle with respect to a plane of the vertical support structure; the vertical support structure comprising first and second vertical support rods, each of the vertical support rods having a first end pivotally coupled to the base support and a second end pivotally coupled to the underarm support; and a hand grip element extending between the first and second vertical support rods and being pivotally coupled thereto.

Other objects, features and characteristics of the present invention, as well as the methods of operation and functions of the related elements of the structure, and the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIGS. 2, 3 and 4 are three separate schematic views of the crutch-like device shown in FIG. 1 in their forward, middle and rear positions during use;

FIG. 6 illustrates a further configuration of the invention wherein the applications are applied to a walker type device;

FIG. 7 illustrates a further configuration of the invention wherein the applications are applied to a cane type device;

FIG. 8 is a perspective view of an alternate underarm rest provided in accordance with the present invention;

FIG. 9 is a perspective view of an alternate hand grip provided in accordance with the present invention;

DETAILED DESCRIPTION OF THE INVENTION

Figure 1:
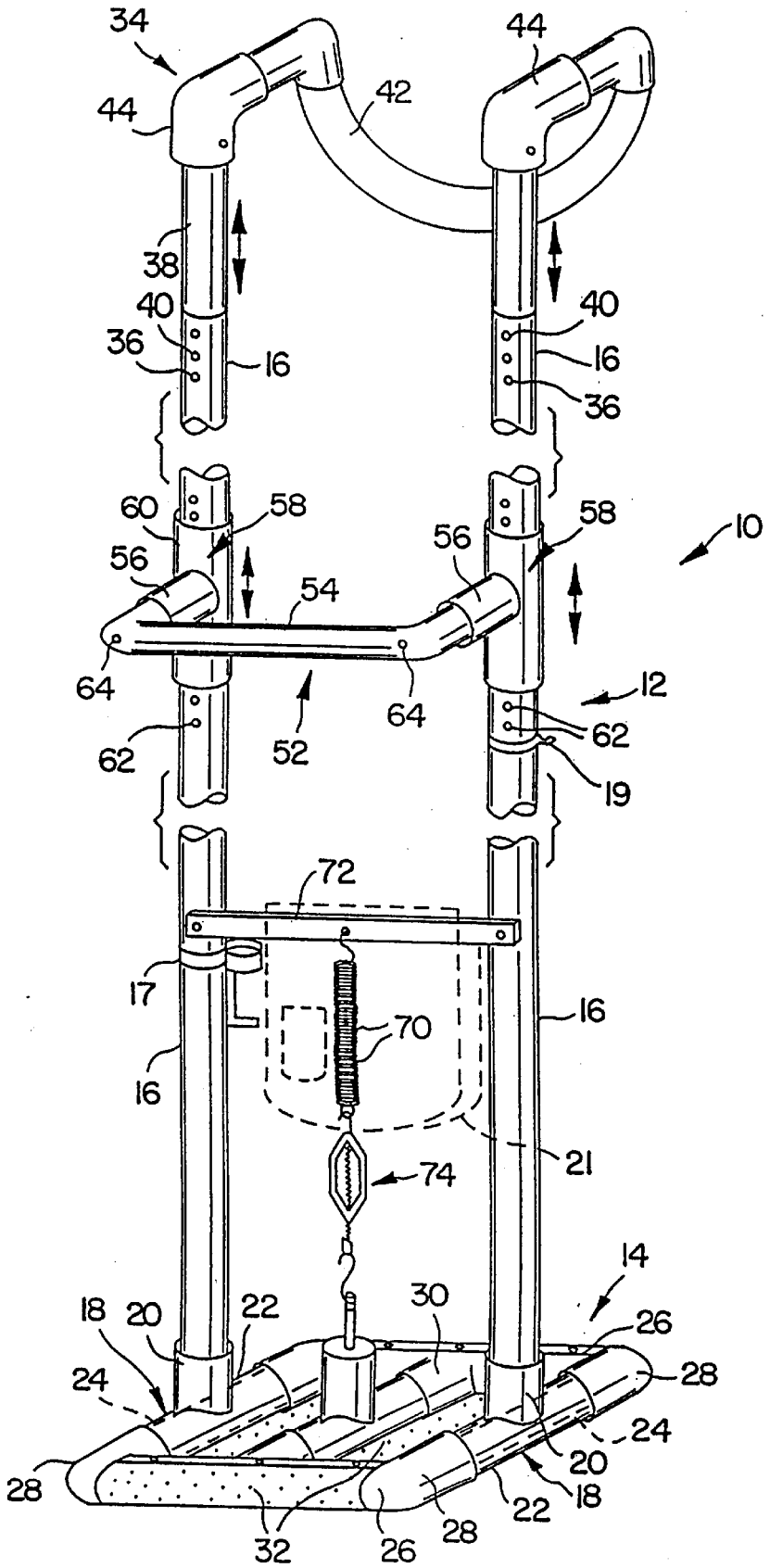
FIG. 1 is a perspective view of a first embodiment of the crutch in accordance with the present invention.

A first embodiment of the invention is shown in FIG. 1. The crutch-like device 10 provided in accordance with the first embodiment of the present invention which may be referred to as the parallelogram configuration, has a substantially vertical main support structure 12 and a substantially horizontal base support structure 14. The vertical support structure 12 is defined by first and second vertical rod members 16. The rod members may be solid or hollow. However, to provide the pivotal interconnections of the present invention and to provide a lightweight crutch structure, the crutch-like device may be formed from, for example, polyvinyl chloride (PVC), wood, aluminum, fiberglass, and graphite piping. Thus, the embodiment illustrated in FIG. 1 includes first and second vertical support rods 16 which may be solid or hollow and each of which is pivotally coupled to the base support structure 14. In the illustrated embodiment, this pivotal coupling is provided by a T-shaped tubular joint 18. The stem 20 of the T-shaped joint 18 is rigidly coupled to the vertical support rod 16 and the cross-bar 22 of the T-shaped joint 18 is rotatably coupled to the base structure 14 as described more fully below.

In the illustrated embodiment, the base support structure 14 is defined by a framework of rod elements including first and second end rods 24 (shown in phantom lines), and first and second side rods 26. The vertical support rods 16 are pivotally coupled to the end rods 24 of the base 14. Thus, the cross-bars 22 of the T-joints 18 are pivotally coupled to the end rods 24. In the alternative, the cross-bars are rigidly coupled to the end rods 24 and the end rods 24 are pivotally coupled to L-joints 28 which are in turn rigidly coupled to the side rods 26 or formed as a part thereof. A cross rod 30 may further be provided as described more fully below.

The coefficient of friction of the base support structure 14 can be desirably increased by mounting an elastomeric element 32 to the base support structure 14 so as to extend across a bottom face thereof. Preferably, the friction enhancing elastomeric element 32 is removable and replaceable so that a variety of materials and/or traction increasing surface configurations can be provided, depending upon the environment in which it is used and the ground conditions, thereby maximizing the effectiveness of the same in maintaining stability of the crutch 10. In this regard, it is also noteworthy that because there are gaps between the tubular elements 26, 30 defining the base support 14 across which the elastomeric element 32 extends, the base support 14 is flexible in part so that it will tend to conform to a rough ground surface while still providing a stable support surface. In the alternative, the material of the base support structure 14 and/or the elastomeric element 32 may be selected to provide this conforming and safety characteristic as may be demanded for particular applications. In addition, the increased area of the base support 14 provides a greater frictional surface which reduces the likelihood of slippage at any point in its travel.

While in the illustrated embodiment the base support structure 14 is substantially square, it is to be understood that the base can be of any shape including circular, rectangular, triangular and the like. Further, the base support structure 14 can be either a solid piece or a frame-like structure as shown. It is also noteworthy that in use, it may not always be possible for the base to be normal to the plane of movement of the crutch. This is because of hills, rocks, uneven walking surface, etc. Therefore, it is intended that the base be able to articulate a certain amount laterally so that it can engage the ground in a manner which maximizes contact therewithin even if it is not placed normal to the vertical portion of the crutch. It is also to be understood that the base 14 of the crutch 10 can be pivotally coupled to a single vertical support member or to first and second vertical support members that are disposed at an angle relative to one another while still realizing the advantages of the structure of the invention. Indeed, it is only critical that the base be at least pivotal relative to the vertical support structure 12 so that, as can be seen in the schematic illustrations of FIGS. 2*a*–2*c*, 3*a*–3*c*, and 4*a*–4*c*, the base 14 of the crutch structure 10 remains in contact with and parallel to the ground throughout the motion of the vertical support structure 12.

It has also been found that the shape of the rigid underarm "U" support is quite important. A further embodiment of this invention is that the underarm support be shaped to fit the user's underarm, or that it contain padding sufficient to obtain full or near full contact with the maximum amount of underarm surface. This is essential not only for comfort, but also so that the weight is more evenly distributed over the underarm thereby reducing the applied force per unit area.

A further embodiment of the invention provides a collapsible crutch assembly. When travelling or riding in a vehicle, or for storage, it is desirable to be able to reduce the size of the kinematic crutch-like device. This may be by means of telescoping the vertical support structure thereby reducing the overall length or by having a joint or hinge which will lock when open, but may be unlocked and pivoted so as to fold the vertical system reducing its length and space requirements.

Individuals using mobility assistance devices often require means to carry such items as briefcases, purses, medical and nourishment, medication or monitoring apparatus. Since the hands of the user are required to facilitate the operation of the kinematic crutch-like device, the crutch means include means for supporting such aforementioned items. Means for carrying such devices include cup holders 17, brackets or hangers 19 and specially designed saddle bags shown in phantom in FIG. 1. The attaching means also can be used for carrying a cellular telephone and other communication equipment, radio and tape players, proximity warning systems, security and safety alarms, and speakers and microphones therefor.

Figure 2A:
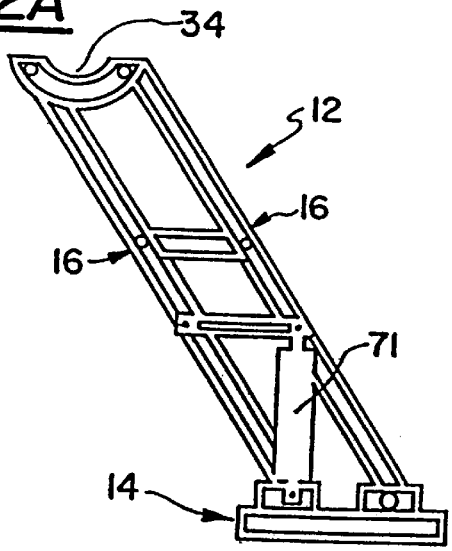
FIGS. 2*a*, 2*b*, and 2*c* show an embodiment in which the spring 70 in FIG. 1 is replaced by a powered actuator to provide a power assisted crutch.
Figure 2B:
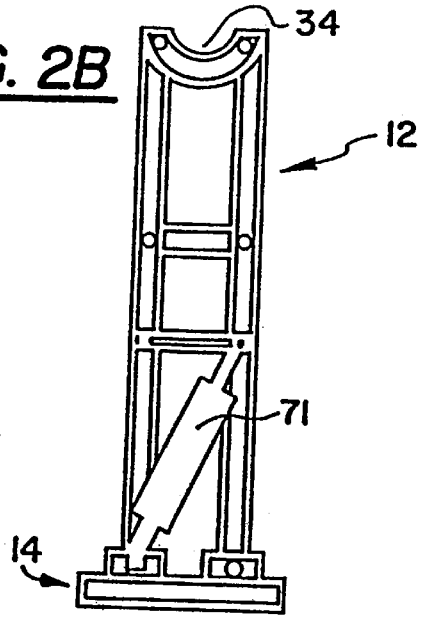
Figure 2C:
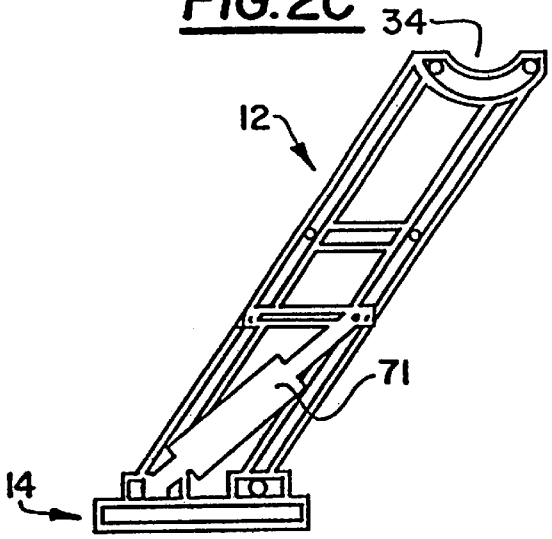
Figure 3A:
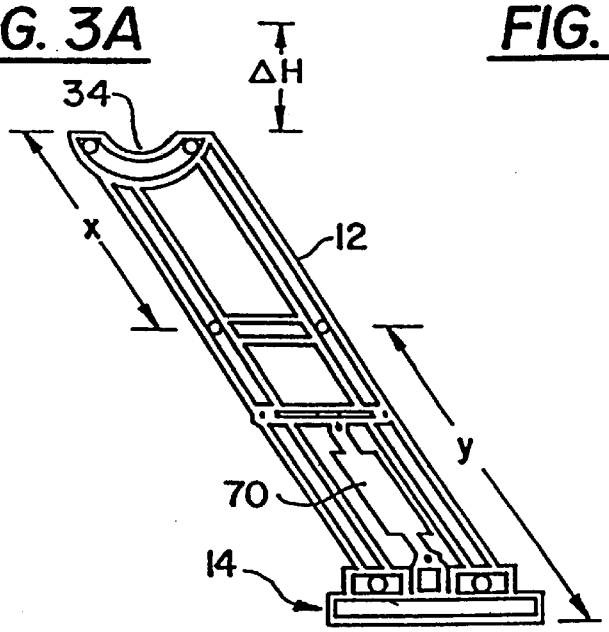
FIGS. 3*a*, 3*b*, and 3*c* show the embodiment shown in FIG. 1 in three position during use.
Figure 3B:
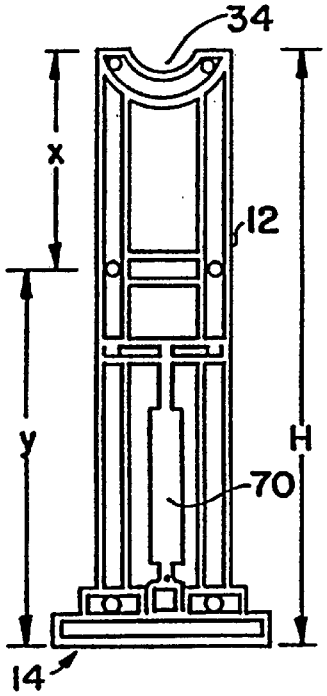
Figure 3C:
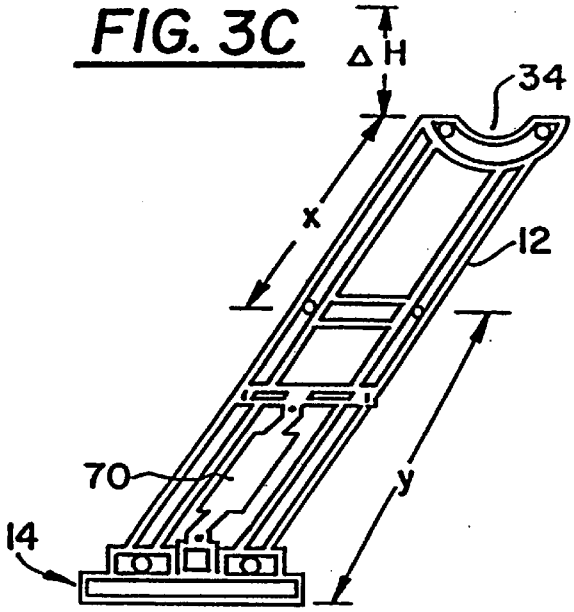

FIGS. 2*a*, 2*b*, and 2*c* show a pneumatic, hydraulic or other form of actuator such as a motor or magnetic drive means. Further, with this power assisted system it is desirable for some users to be able to control the action of the base and the crutch motion. This can be accomplished via a button or switch on the hand grip or on the base which functions when it is used. For example, if the crutch is in the forward position (FIG. 2*a*) and the user wishes to move forward, they could activate the switch and such actuators would assist the user in moving forward by causing the top of the crutch to move from the rear to the forward position.

Referring to FIG. 2, the embodiment is illustrated as a power assisted crutch. In this example, the actuator 71 in FIG. 2*a* is actuated by a control switch which is mounted in the crutch, the handle 54 (FIG. 1) or on the crutch base 14. The switch on the base 14 (FIG. 2) is provided so that when the crutch is in the forward position (FIG. 2*a*), the switch is automatically actuated and the actuator extends moving the crutch members 12, as well as the entire crutch, to the center (FIG. 2*b*), and then to the rear position (FIG. 2*c*). At this position, the switch can either automatically or manually deactivate the system.

The power assisted crutch will greatly reduce the effort required for obtaining mobility with a crutch. This is of special value to those who, because of their functional limitations, must now be confined to a wheelchair, or can only use crutches for a limited time because of weakness.

A spring element 70 (FIG. 3) is preferably mounted to extend between the base structure 14 and the vertical support elements 12, as shown in FIG. 1, so as to urge the support structure 12 and base 14 into a substantially perpendicular disposition. In the embodiment of FIG. 1, the spring 70 is coupled centrally to a cross rod element 30 of the base 14, and is coupled to an elongated support 72, for example, pivotally coupled to each of the support rods 16. The spring element 70 dampens the pivotal motion of the vertical support structure 12 relative to the base 14 and, therefore, adds stability to the crutch structure 10. More particularly, with reference to FIGS. 3*a*, 3*b* and 3*c*, the spring or tension device 70 facilitates use of the crutch as follows. When the crutch 10 is placed in the forward position, the spring 70 is under tension and the articulated base 14 lays flat on the walking surface. To walk with the crutch, the user swings their body forward. While doing this the force from spring 70 assists the user in walking on the crutch 10 by reducing the effort or force needed to move forward. The result of the spring action changes as the cycle continues. As the user has the crutch 10 directly under him, the tension is at its lowest point. Then, as the user passes through this point and the crutch 10 moves rearwardly, the spring 70 is again placed under tension which causes the user to slow down. Provision is made as well for the tension on the spring 70 to be adjusted as a function of the user's weight, and ease of use. Thus, the spring or other tension producing means is provided with a tension adjusting device such as a turn buckle 74.

Further, the spring-like action is desirable but not essential for the crutch to operate. Indeed, the device will operate with or without the tension producing means and some users may find it easier to use without tension loading.

Figure 4A:
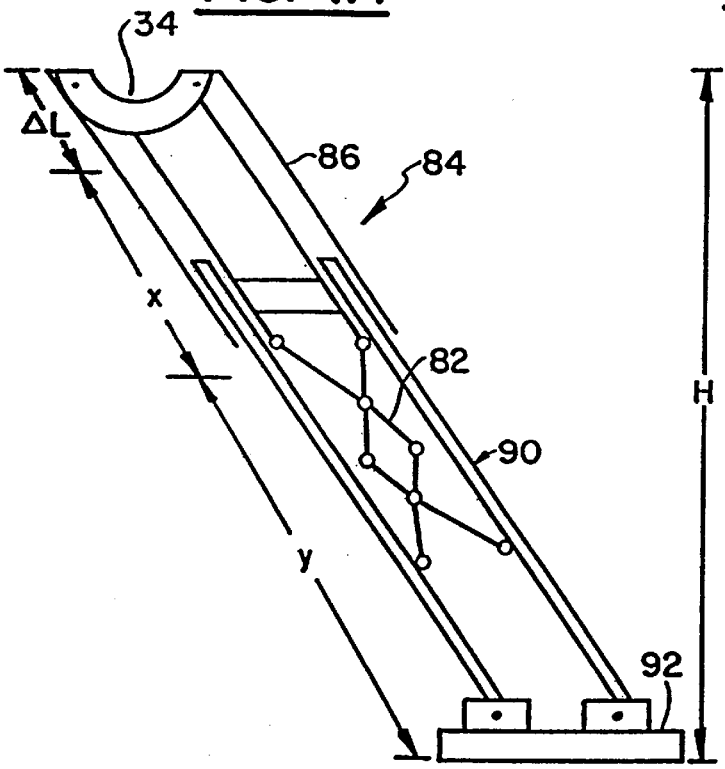
FIGS. 4*a*, 4*b*, and 4*c* show a further embodiment where the upper portion of the crutch is raised and lowered via a mechanical or cam linkage 82 so that the underarm support is raised and lowered as the crutch moves from the forward to the rear position.
Figure 4B:
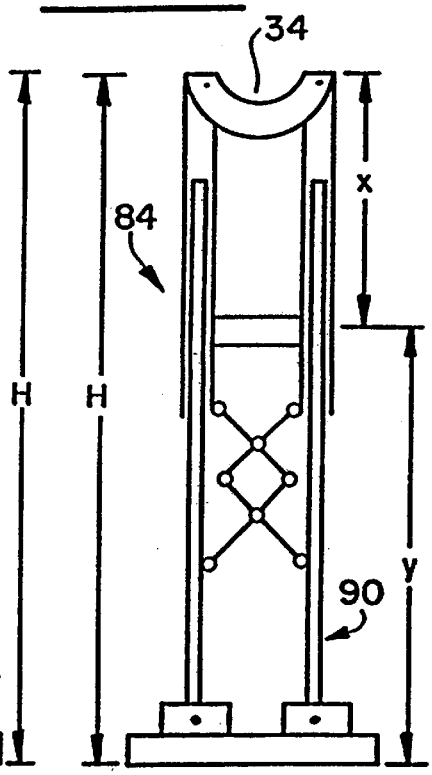
Figure 4C:
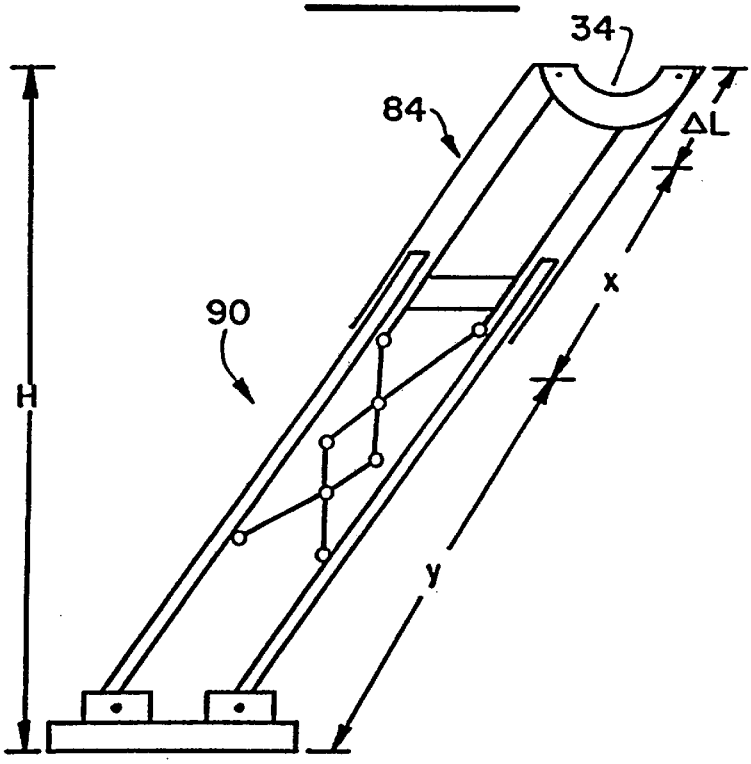
Figure 5:
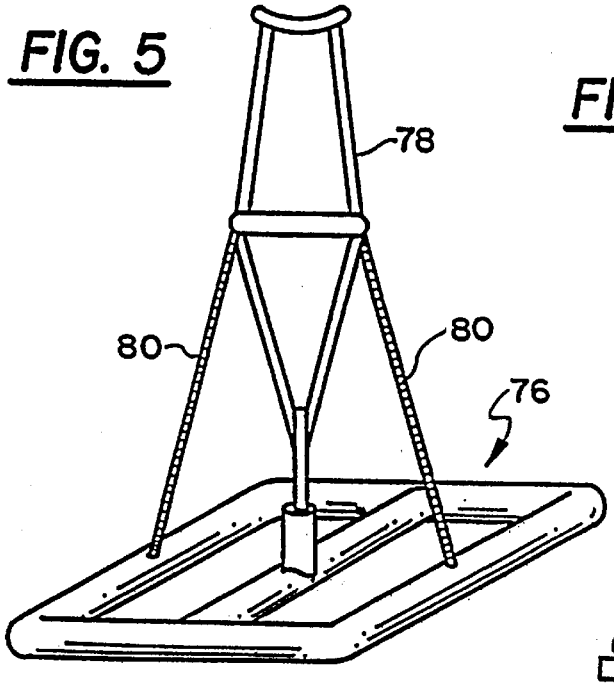
FIG. 5 illustrates an alternate configuration of the invention in conjunction with a conventional crutch.
Figure 5A:
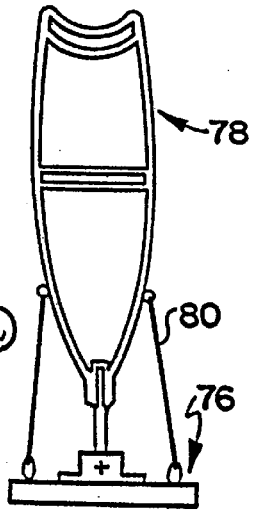
Figure 5B:
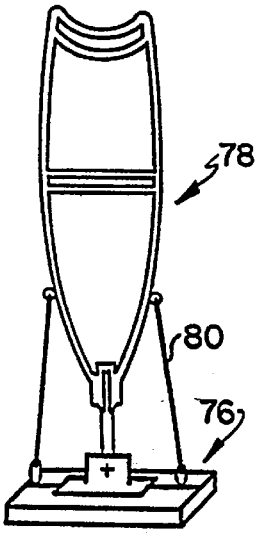
Figure 6A:
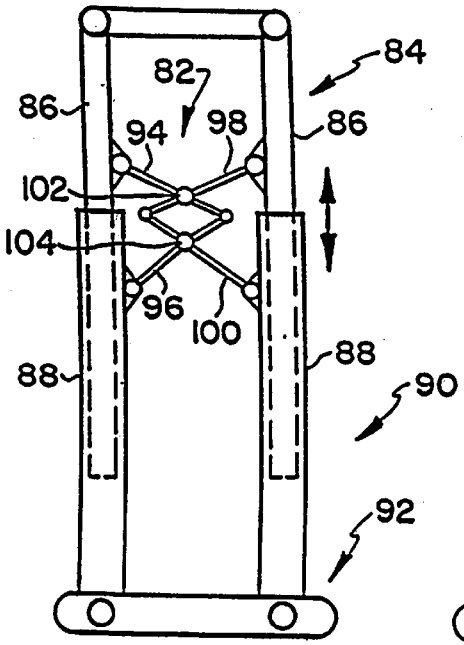
FIGS. 6*a* and 6*b* are detailed illustrations of the embodiment of FIGS. 4*a*–4*c;*
Figure 6B:
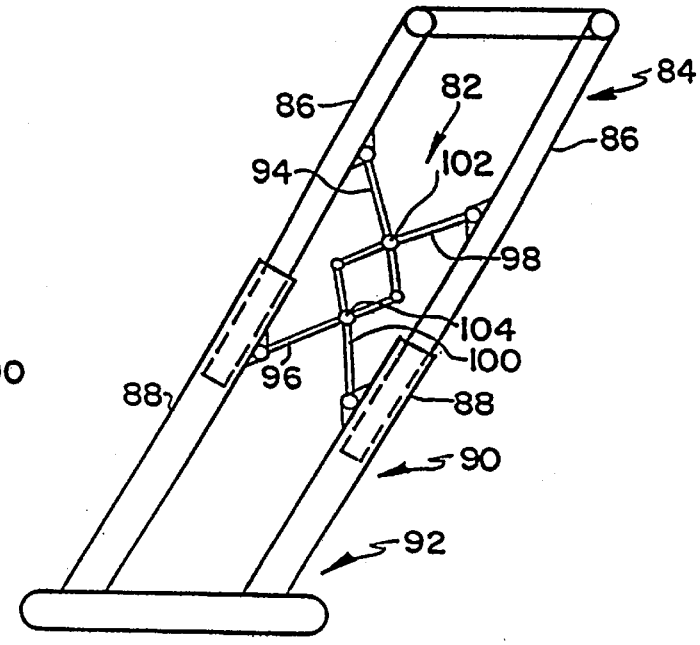

A further feature of the present invention is illustrated in particular in FIGS. 4*a*, 4*b*, and 4*c*, and in FIGS. 6*a* and 6*b*. In this embodiment, a linkage system 82 is provided which maintains a constant height for the crutch-like device. Thus, as shown schematically in FIG. 6*a*, by way of example, an upper portion 84 of the crutch device including first and second rods 86 is telescopingly received in first and second vertical tubes 88 defining the lower portion 90 of the crutch device. The tubes 88 are pivotally mounted to a base 92 which is substantially similar to the base 14 illustrated in and described with reference to FIGS. 1 and 5. The illustrated linkage system 82 includes a first linkage rod 94 pivotally mounted at a first end thereof to one of the telescopingly received rods 86 and pivotally coupled at the other end thereof to a second linkage rod 96 which is in turn pivotally mounted to the tube 88 which receives the first rod 86. A third linkage rod 98 is pivotally mounted to the other of the telescopingly received rods 86 and pivotally mounted at its other end to a fourth linkage rod 100 pivotally coupled to the other tube 88. The first and third linkage rods 94, 98 are pivotally coupled at 102 and the third and fourth rods 96, 100 are pivotally coupled at 104. As the upper portion 84 of the crutch device is moved, for example, to the right, the linkage system 82 causes the upper portion 84 of the crutch to move vertically upwardly out of the tubes 88 to the position shown, for example, in FIG. 6*b*. Thus, the overall length of the crutch device between the base and the uppermost underarm support increases whereas the overall vertical height of the crutch device remains constant. Compare FIG. 3 wherein the length of the device remains constant (x+y) and the overall height changes by H to FIG. 4 wherein the length of the device changes (x+y+L) but the overall height H remains constant. Because the height of the device remains constant, the user of the crutch need not pass through an arc as is the case with typical crutches and, thus, the pressure on the underarm will be maintained constant. Furthermore, because the user does not need to "hop" or otherwise skip through the center point of the pivoting motion, the user can stand on a wheeled or sliding platform, or have a wheel or wheels attached to a cast, for example, and simply use the pull and push motion afforded by the frictional engagement of the crutch with the ground to impart mobility. While a particular linkage system is illustrated, it is to be understood that other linkage systems or a camming mechanism, for example, between the vertical upper portion of the crutch and the tubular members could be provided to maintain a constant height for the crutch-like device. It is to be noted that a telescoping structure is not necessary as other means can be used such as slotted members, or other extension means.

The crutch-like mobility assisting device 10 of the invention also minimizes discomfort and/or injury to the underarm area in one of two ways. If the parallelogram configuration of FIG. 1 is utilized, the underarm end of the parallelogram structure is pivoted relative to the vertical support rods 16 so as to move forward and back. More particularly, the underarm support structure 34 is slidably mounted to the vertical support rods 16 and vertically adjustable relative thereto by aligning apertures (not shown) defined through vertically extending portions 38 of the underarm support 34 and corresponding apertures 40 defined through the vertical support rods 16 and inserting one or more pins 36 or other fastening means. Further, the cross-bar member 42 of the underarm support 34 is pivotally mounted to L-shaped joints 44 which are rigidly coupled to the vertically upper end of the vertical portions 38 of the underarm support 34.

The cross-bar member 42 (arm rest) is secured to the L-shaped joints 44 with, for example, a nut and bolt (not shown). Because the cross-bar member 42 is pivotally mounted to the vertically extending portions 38, which are in turn slidably coupled to the vertical support rods 16 of the crutch device 10, the underarm support 34 is pivotal relative to the vertical support structure 12 and remains parallel to the underarm during motion of the crutch 10 as shown in the schematic representation of FIGS. 2, 3, and 4. Because the underarm support 34 does not move with respect to the underarm, the pressure against the underarm of the user remains constant and is uniformly distributed throughout the entire movement of the crutch 10. This eliminates the problems of injury caused by a constantly moving pressure point and abrasive rubbing action between the underarm support of conventional crutches and the underarm. The underarm engaging portion of the crutch of the invention as shown can be curved and/or padded to conform to the shape of the underarm to further minimize the likelihood of injury or abrasion at its point of contact with the user's anatomy.

As is shown in FIG. 1, in particular, the underarm support 34 is preferably offset relative to the vertical plane of the vertical support structure 12 so that in use, the vertical support structure 12 is offset from the user's body. This offset dimension can be adjusted to fit the size of the user. Offsetting the vertical support 12 in this manner makes the crutch ergonomically correct and enables it to be used in a vertical plane minimizing the likelihood that the crutch structure 10 will contact the user's sides or legs during use.

As shown in FIG. 8, the second method of minimizing discomfort and injury of the sensitive underarm area is by providing an independently rotatable arm support. In the illustrated embodiment, the support includes a circular or semi-circular underarm engaging element 48 which is rotatably mounted within a circular or semi-circular mounting element 50. The mounting element 50 can be pivotally coupled to the vertical support structure 12 of the crutch 10 directly by means of pivot pins or indirectly by means of vertically extending tubular elements to which the mounting element is pivotally coupled and where are in turn slidably mounted to the vertical support structure 12. The underarm support of FIG. 8 provides an even distribution of load during the use of the crutch and eliminates the rolling motion of the crutch against the underarm.

As a further feature of the present invention, the hand grip 52 is slidably mounted to the vertical support structure 12 and pivotal relative thereto. Thus, in the embodiment of FIG. 1, the hand grip 52 is slidably mounted to the first and second vertical support rods 16. In that embodiment, the hand grip 52 is defined by a cross-bar member 54 which is pivotally coupled to the stems 56 of first and second T-shaped tubular joints 58. The cross-bars 60 of the T-shaped joints 58 are in turn slidably mounted to the vertical support rods 16. The dimension between the cross-bar member 54 and the vertical rods 16 can be regulated for the user's comfort. Thus, the hand grip structure 52 may be fixedly secured at one of a number of predetermined levels on the support rods 16 by inserting a bolt (not shown), for example, through an aperture (not shown) defined in the T-joint, through one of several apertures 62 defined through the vertical support rods 16 and an aperture 64 defined in the cross-bar member 54. The locking bolt is secured in its inserted position with, for example, a nut screwthreaded to the end thereof which extends through the cross-bar member 54. Such locking bolts also secure the cross-bar member 54 to the T-shaped joints 58.

The structure of FIG. 1 provides a hand grip 52 that remains parallel to the walking surface. This provides a uniform force to the hand and wrist but the wrist must bend from the forward to the rear. While this is desirable for many users, there are, however, those who either cannot or prefer not to move or bend their wrist.

As an alternative, then, a circular or semi-circular element 66, or pivotally mounted handle can be attached to the vertical support structure 12 with a hand grip element 68 rotatably mounted therewithin, as shown in FIG. 9. In this manner, the hand grip is freely rotatable relative to the crutch support structure so that it can be easily gripped in a comfortable manner by the user and at a desired angle relative to the vertical support structure 12 for facilitating use of the crutch. Indeed, with such a grip, the hand need not rotate at the wrist as the grip itself rotates as the crutch is moved.

As shown in FIG. 5, an alternate embodiment of the present invention is shown. In this embodiment, the base 76 is designed so that it can either be built onto, or attached to a conventional crutch 78 to give it greater stability and reduce the likelihood of slipping upon surface hazards. The spring stabilizers 80 are coupled in any suitable manner to the vertical crutch structure 78. The base 76 itself is substantially similar to the base support structure illustrated in FIG. 1.

As is apparent from the foregoing, the articulated vertical support structure and flat base provided in accordance with the present invention can be employed not only in crutch-like devices but could also be employed for each of the three or four legs of a walker-type device which is manually grasped and leaned upon to facilitate mobility (FIG. 6). Similarly, the articulated base and vertical support structure of the invention could be employed as a walking stick, cane or the like (FIG. 7).

As can be seen, if the upper telescoping portion of the crutch 38 (FIG. 1) is removed, the lower portion can be used as a cane or two crutches can be joined to form a walker as seen in FIG. 6. In the lowermost position, the underarm grip or an accessory grip can be used as a hand grip so that the device can serve as a cane.

In the alternative, the base 76 of FIG. 5 can be mounted to the tip of a conventional cane as shown in FIG. 7.

As a further example, brackets can be provided to attach the left and right crutches to form a walker-type structure. Another alternative is to provide a separate four-legged walker having articulated bases of the type shown in FIG. 5.

In alternative embodiments of the mobility assisting device as shown in FIGS. 10–23, the vertical support structure is coupled to the base by a pivotal connection that enables a side-to-side pivotal motion with respect to the vertical plane of the support structure. The crutch 110 as shown in the embodiment of FIG. 10 includes similar structural elements as the embodiment of FIG. 1 and which operate in a similar fashion.

Figure 10:
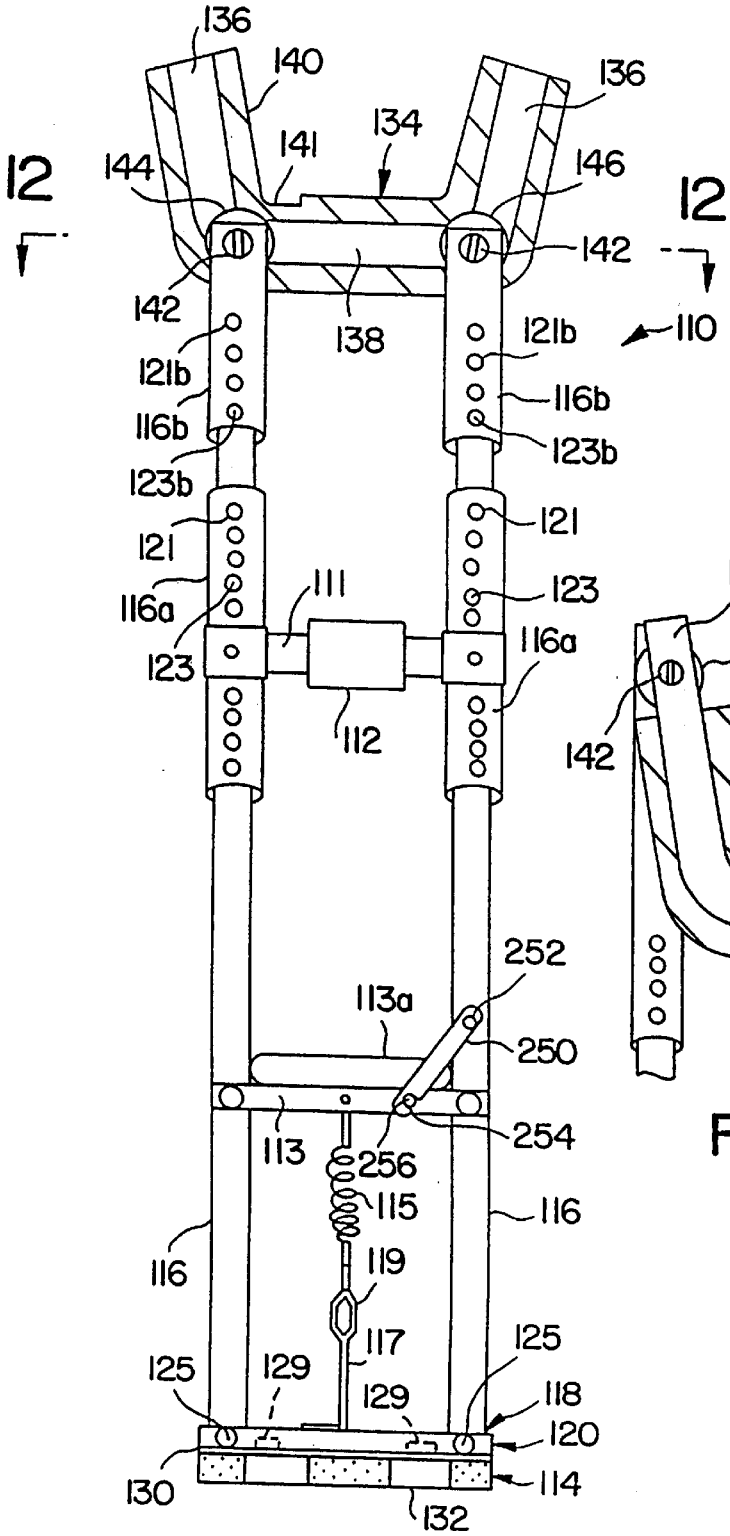
FIG. 10 is a side view of a further embodiment of the crutch.
Figure 11:
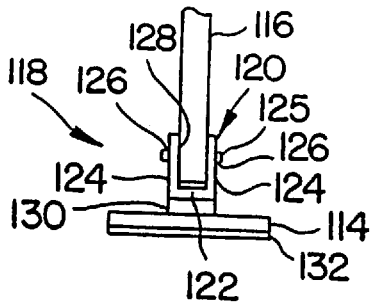
FIG. 11 is a partial end view of the crutch as seen along line 11—11 in FIG. 10.

Referring to FIG. 10, vertical support rods 116 are pivotally coupled to base 114 by a pivotal joint 118. The pivotal joint 118 allows articulation of the base with respect to the vertical support rods 116 in a side-to-side direction and in a forward and backward direction to enable the base 114 to fully engage the ground regardless of the incline. As shown in FIG. 11, the pivotal joint 118 includes a U-shaped bracket 120 having planar bottom wall 122 and parallel upright sidewalls 124 defining an elongated channel. The bracket 120 has a length to extend between the vertical support rods 116. The vertical support rods 116 are coupled to the U-shaped bracket 120 by a bolt 125 extending through aligned holes 126 in each of the upright sidewalls 124 and hole 128 in the vertical support rods 116. The bolt 125 extending through the bracket 120 and vertical rods 116 allow the vertical rods to pivot in the plane of the longitudinal dimension of the bracket 120. The bracket 120 is coupled to the base 114 by bolts 129 extending through a hole in the bottom wall 122 and through a hole in the base 114. The hole in the bottom wall 122 is dimensioned to allow some pivotal movement of the bracket 120 with respect to the base. A resilient shock dampening pad 130 is positioned between the U-shaped bracket 120 and the base 114. A resilient, non-skid pad 132 covers the bottom surface of the base 114.

The bolts 129 coupling the U-shaped bracket 120 to the base 114 are tensioned against the resilient pad 130 so that the bracket 120 and the base 114 positively engage the resilient pad 130 and bias the bracket and vertical support tubes 116 in an upright position with respect to the base 114. The resilience of pad 130 in combination with the two bolts 129 passing through the U-shaped bracket 120 allow the bracket 120 to pivot slightly in a side-to-side direction on the base 114 while being biased in the normal upright position as shown in FIG. 11. The base 114 engages the ground regardless of the angle of the support structure with respect to the ground by the base pivoting in a first longitudinal direction with respect to the plane of the support structure and in a second transverse direction perpendicular to the first direction. Further, the base 114 is biased to the normal upright position by separate biasing means in each direction. The resilient pad 130 is preferably a polymeric rubber-like material such as, for example, a neoprene foam.

The bolts coupling the various elements together may be a standard nut and bolt assembly to allow easy disassembly and repair. Alternatively, a pin and retainer clip may be used. In embodiments of the invention, the base 114 may be detachable to allow replacement of the base with a different size or shape of base.

The vertical support structure is preferably adjustable and collapsible by including telescoping tubes with suitable locking mechanism to adjust the height to the user. In the embodiment shown in FIG. 10, the locking mechanism is a spring biased detent which engages a hole in the telescoping tube. In this embodiment the cross-bar 111 is coupled to a tube 116*a* having a plurality of holes 121. A spring biased detent 123 is provided in rod 116 to selectively engage one of the holes 121. An upper hollow tube 116*b* also includes a plurality of holes 121*b* for receiving a spring biased detent 123*b*. The height is adjusted by pressing the detent inwardly and sliding the outer tube over the detent until the detent snaps into the adjacent hole. As can be seen, the height of each end of the underarm support 134 and the cross-bar 111 are independently adjustable so that the angle of the underarm support 134 and the cross-bar 111 can be selectively adjusted to accommodate the user as needed.

A horizontal cross-bar 111 having a hand grip 112 is pivotally coupled to each rod 116. An intermediate cross-bar 113 also extends from each rod 116 and is coupled thereto by a pivotal connection. A spring 115 extends from bracket 120 to horizontal bar 113 in a manner similar to the embodiment of FIG. 1. In preferred embodiments, an L-shaped rigid bracket 117 is fixed to channel 120 by bolts, screws, rivets or other fasteners. The spring 115 is in turn connected to bracket 117 through a tension adjusting means, such as turn buckle 119. In this manner the distance between the end of the bracket 117 and the spring coupling point on cross-bar 113 increases as the support rods 116 pivot from the perpendicular position with respect to the channel 120 so that the spring 115 biases the support rods 116 to the upright position.

In the embodiment of FIG. 10, the underarm support 134 is a rigid structure generally conforming to the shape of the user's underarm. The underarm support 134 is a rigid tubular member with a substantially U-shape having a pair of upright legs 136 extending from each end of a horizontal cross-bar 138. As shown in FIG. 10, the legs 136 extend at an acute angle from the cross-bar 136, typically at about 30°. The ends of the horizontal cross-bar 136 are pivotally connected to the upper ends of the vertical support rods 116. A resilient foam cushion material 140 encases the underarm support to provide added comfort to the user by making maximum contact with the underarm. The cushion material 140 provides maximum contact with the underarm to enable the user to place their weight on the underarm support without irritation. Typically, the cushion material 140 provides about 12 square inches of contact with the underarm. The underarm support is preferably readily removable so that different size underarm supports can be attached to the vertical support rods depending on the size of the user. A removable coupling can be used to allow rapid replacement of the underarm support without changing the spacing between the vertical support rods since the spacing of the rods is independent of the size of the underarm support.

In preferred embodiments, the underarm support is dimension to fit snugly under the user's arm to provide full support thereby permitting the user to place a substantial portion of their weight on the underarm support 134. Since the dimensions of the arm and shoulder vary with the user, it is preferable to provide different size underarm supports to accommodate different users. The upright legs 136 are preferably angled with respect to the cross-bar 138 to firmly engage the front and rear surfaces of the shoulder of the user to distribute the weight of the user throughout the underarm. In addition to the replaceable underarm support, the upper tubes 116*b* may also be replaceable to accommodate different size patients. In this manner, the same basic assembly may be used for different size people.

The arrangement of the underarm support 134 being connected to support rods 116 as shown in FIG. 10 is generally more preferred than the embodiment of FIG. 1. By pivotally coupling the underarm support to the support rods 116 at the horizontal cross-bar 138 as shown in FIG. 10, the spacing between the rods 116 can be reduced and the length of the rods 116 can be shortened thereby reducing the overall weight and bulk of the crutch. In addition, the spacing of the rods 116 is independent of the dimension of the underarm support.

Typically, prolonged use of conventional crutches result in irritation to the underarm by friction and uneven pressure to the underarm. In particular, pressure to the radial nerve extending through the rear portion of the underarm produces irritation. In the embodiment of the invention shown in FIG. 10, the resilient cushion material 140 is provided with a recessed area 141 to reduce contact and pressure on the radial nerve and the other nerves in the axilla thereby reducing discomfort to the user.

To facilitate a more ergonomically designed kinematic crutch, the underarm structure is placed at an angle relative to the plane of movement of the co-liner supporting structure 116. Typically, it is desirable to have the base move and point in the direction of travel. Since the angle of the underarms is generally about 10–20 degrees with respect to the forward direction of travel of a person, the base becomes towed inward when the underarm support is parallel to the support structure. To straighten the base, the user must turn the crutch so that the base points forward. When this is done, a torsional force is applied to the underarms of the user resulting in discomfort and difficulty in use. Placing the underarm support at an angle which is the same as the angle of the underarm eliminates this problem, and enables full underarm contact while enabling the base to point directly forward during use of the crutch. The entire kinematic crutch system functions without causing any strains on the body, making it safer, easier to use and to operate.

In use, the vertical support tube 116 will assume a normal upright position as shown in FIGS. 10 and 11. When the base 114 is positioned in a forward position with respect to the user and the vertical support tube 116 is not perpendicular to the ground, the base 114 is able to pivot to make full contact with the ground in a manner substantially the same as shown in the embodiment of FIG. 2*a*. The resilient pad 130 further functions as a shock absorber to reduce the shock of the base striking the ground from being transferred through the vertical structure 114 to the user.

In embodiments of the invention, the cross-bar 113 functions as leg or foot rest while the user is seated. A foam cushion material 113*a* covers the cross-bar 113 to provide added comfort while keeping the user's leg or foot elevated.

While the pad 113*a* is being used as a foot rest, it is desirable to provide a locking mechanism to prevent the support rod 116 from pivoting with respect to the cross bar 113 and the base 114. It is also desirable to fix the support rods 116 with respect to the base 114 and the cross bar 113 while going up and down stairs and during storage to enable the assembly to stand upright. In the embodiment shown in FIG. 10, the locking mechanism is a brace 250 pivotally connected at one end to support rod 116 by a pin 252. The opposite end of the brace 250 includes a notch 254 for receiving and engaging a locking pin 256 in the cross bar 113. The notch 254 is hooked over the pin 256 to lock the support rod 116 with respect to the cross bar 113. The braces 250 and can be unhooked from pin 256 to allow the pivotal movement of the support rods 116. Although the brace 250 is shown being coupled to the support rod 116 above the cross bar 113, the brace may be positioned in any suitable arrangement. For example, the brace may be pivotally coupled to the support rod 116 below the cross bar 113, or pivotally coupled to the cross bar 113 and hooked to the support rod by a similar locking pin. Alternatively, the brace may be pivotally coupled to the base or support tube and hooked to the support tube or base, respectively.

In an alternative embodiment, the vertical support tube 116 and U-shaped bracket 120 are coupled to the base 114 via a coil spring (not shown) instead of the resilient pad. In this manner, the vertical support tube 116 is able to pivot in two directions with respect to the base when the base is on an inclined surface. The base is spring biased back to its normal position perpendicular to the vertical support tube when the base 114 is lifted from the ground. The biasing of the base 114 with respect to the U-shaped bracket 120 further provides a shock dampening affect when the base engages the ground. In further embodiments, a shock dampening arrangement can be provided in the support structure or in the underarm support.

The embodiment of FIG. 10 shows a standard cushioned handgrip. In alternative embodiments handgrips or other means may be used to accommodate the particular needs of the person. For example, a cuff may be used to accommodate a prosthetic arm. A hand hold with finger holes to enable an arthritic patient to grip the crutch may also be used.

The crutch 110 of FIG. 10 is used and functions in a manner similar to the embodiment of FIG. 1 where the vertical support tubes 116, base 114 and underarm support 134 form a parallelogram. In this manner, the base 114 is able to remain essentially perpendicular to the ground at all times and the underarm support will not slide or rub against the user's underarm. The underarm support remains in a fixed position with respect to the underarm since the support rods are able to pivot with respect to the underarm support.

The upper tubes 116*b* and the underarm support 134 may be removed so that the lower portion including the hand grip 112 may be used as a cane. A forearm cuff may be attached to one of the tubes 116*a*. This results in a cane assembly having a pair of vertical support tubes and base that is pivotable with respect to the support tubes.

Figure 10A:
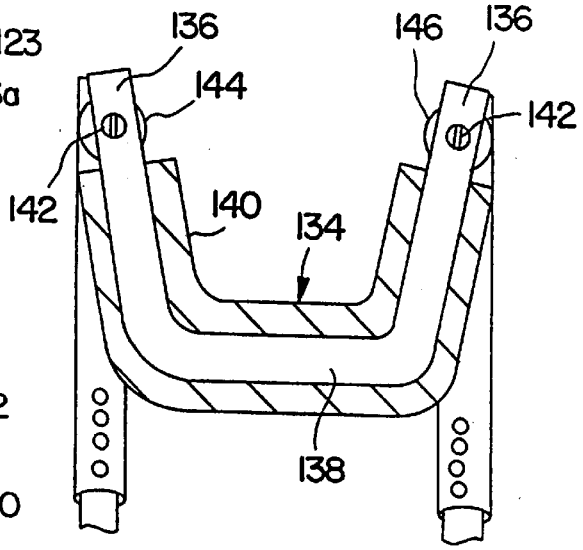
FIG. 10*a* is a partial side view of the underarm support in an alternative embodiment where the underarm support is attached to the vertical tubes at the upper ends of the underarm support.

In an alternative embodiment shown in FIG. 10*a*, the underarm support 134 is pivotally attached to rods 116 at the upper ends of the legs 136. This arrangement spaces the vertical rods 116 further apart than the embodiment of FIG. 16 which may be desirable to accommodate the personal needs of the user. The underarm support can be replaced with a different size underarm support to accommodate different size patients. In further embodiments the underarm support can be coupled to the support rods at any desired location on the underarm support. For example, the underarm support may be coupled to the support rods at a midpoint of the legs 136.

Figure 12:
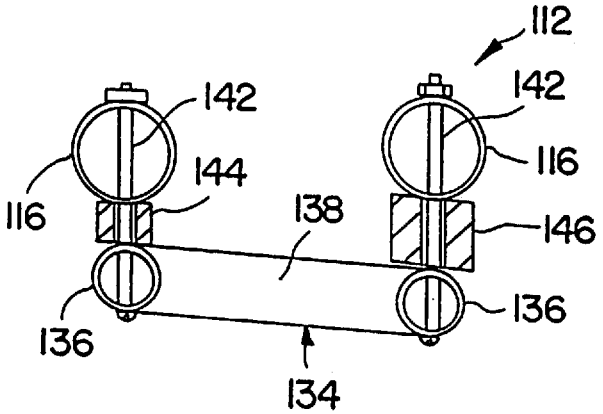
FIG. 12 is a cross-sectional view of the underarm support taken along line 12—12 of FIG. 10.

Referring to FIG. 12, the underarm support 134 is preferably offset from the vertical support rods 116 such that the underarm support is spaced from the support rods 116 toward the user. The horizontal cross-bar 138 of the underarm support 134 is coupled to the vertical support rods 116 by a bolt 142 extending through cooperating holes in the cross-bar and holes in the vertical support rods.

In embodiments of the invention illustrated in FIG. 12, the crutch also includes means to adjust the angular position of the underarm support 134 with respect to the plane of the tubular main support structure. This allows the user to selectively adjust the angle of the underarm support to their particular needs. In the embodiment of FIG. 12, the underarm support 134 has an overall U-shape with the horizontal load bearing cross-bar 138 and two upwardly extending bars 136 coupled to the vertical tubes 116 by a pair of bolts 142. The forward side of the underarm support 134 is spaced from the vertical rod 116 by a first spacer 144. The rear side of underarm support 134 is spaced from the other vertical rod by a second spacer 146 which is wider than spacer 144 so that the underarm support is angled with respect to the plane of the main support structure 112. In preferred embodiments, the first spacer 144 is about ¾ inch (1.9 cm) wide and the second spacer 146 is about 1 ¾ inch (4.5 cm) wide.

The spacers 144, 146 in this embodiment are cylindrical disk shaped members having a central hole for receiving bolt 142. The spacers can be removed and replaced with different size spacers to selectively adjust the angular position of the underarm support and the spacing of the underarm support from the plane of the crutch.

Figure 13:
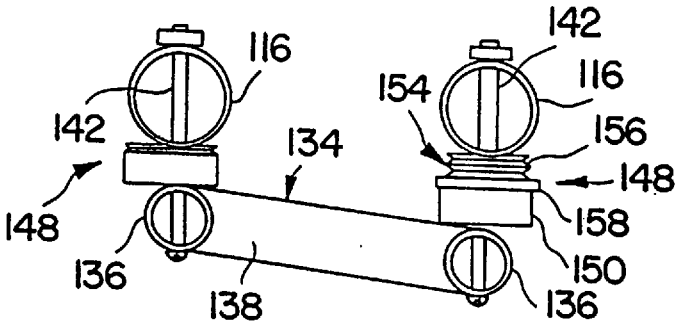
FIG. 13 is a partial cross-sectional view of a further embodiment of the adjustable underarm support.
Figure 13A:
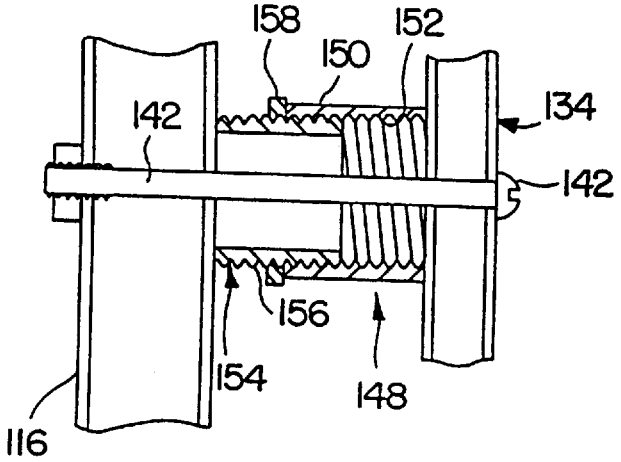
FIG. 13A is a partial cross-sectional view of the adjustable underarm support of the embodiment of FIG. 13.

In a further embodiment shown in FIGS. 13 and 13*a*, the underarm support 134 is spaced from the main support structure by adjustable spacers 148. The underarm support 134 preferably includes a cushion material similar to that shown in the embodiment of FIG. 10. The adjustable spacers 148 include an outer tubular member 150 having internal threads 152 and an inner tubular member 154 having outer threads 156. The inner tubular member 154 is able to telescope within the outer tube 150 to selectively adjust the width of the spacer 148 by rotating the inner tubular member 154 with respect to the outer tubular member 150. An optional locking ring 158 may be used to keep the inner and outer tubular members in the desired position. The inner and outer tubular members 150, 154 are preferably hollow to allow the screw 142 to pass through to attach the underarm support 134 to the main support structure 112.

In an alternative embodiment, the inner tubular member 154 may be slidable within the outer tubular member 150 and locked in position by a set screw (not shown) extending through the outer tubular member to engage the inner tubular member.

Figure 14:
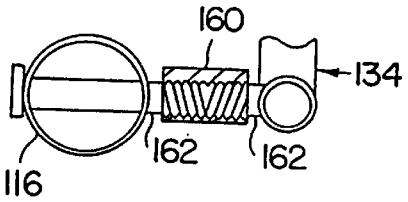
FIG. 14 is a partial cross-sectional view of an alternative embodiment of the adjustable underarm support.

Referring to FIG. 14, a further embodiment of the adjusting means to adjust the angular position of the underarm support is shown. In this embodiment, a turn buckle arrangement including an internally threaded coupling 160 receives the oppositely threaded bolts 162 extending from each of the support rods 116 and each end of the underarm support 134. The spacing between the vertical support rods 116 and the underarm support 134 is adjusted by rotating the coupling 160. Selectively adjusting the turn buckle on each end of the underarm support enables the angular adjustment of the underarm support with respect to the structure 112.

Figure 15:
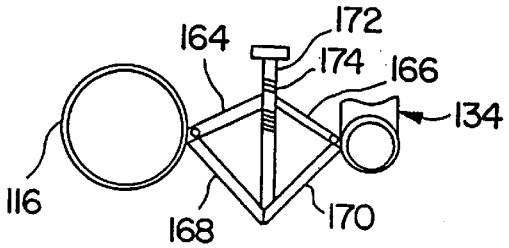
FIG. 15 is a partial cross-sectional view of a further embodiment of the adjustable underarm support.

In a further embodiment shown in FIG. 15, the underarm support 134 is coupled to the vertical support rod 116 by an adjustable scissors-type arrangement. The adjustable arrangement includes a pair of arms 164, 166 pivotally coupled to the support rod 116 and a pair of arms 168, 170 pivotally coupled to the underarm support 134. The arms 164 and 168 are pivotally coupled to coupling member 172 while arms 166 and 170 are pivotally coupled together about their free ends. The coupling member 172 includes a threaded bore receiving threaded screw 174 having one end fixed to the pivotal connection between arms 168, 170. Turning the screw 174 allows the spacing between the support rod 116 and underarm support to be selectively adjusted.

In addition to the above-noted adjustment arrangements for the underarm support, other mechanisms may also be used. For example, one end of the underarm support may be attached to the vertical support tube by a connection allowing some pivotal movement therebetween. The opposite end of the underarm support may be connected to the other vertical support tube by an adjustable coupling to adjust the angle of the underarm support with respect to the plane of the support structure.

Figure 16:
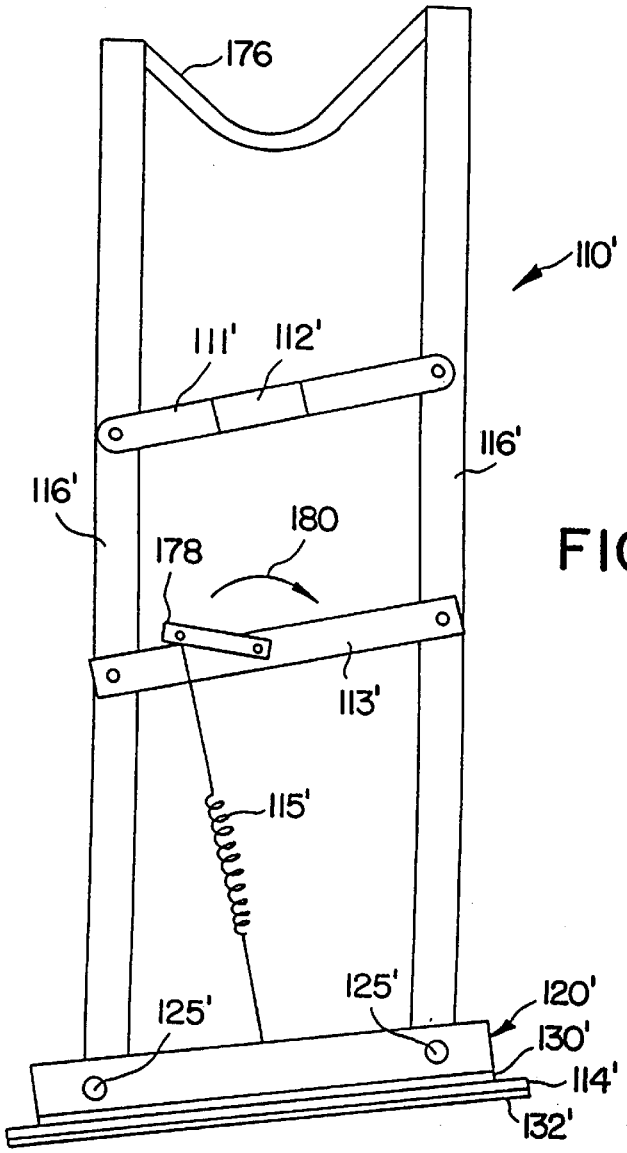
FIG. 16 is a side view of a further embodiment of the crutch.

In a further embodiment shown in FIG. 16, the underarm support is replaced with a flexible sling support 176. In a preferred form, the sling is elastic to stretch slightly when the weight of the user is applied to the sling and relax when the weight is decreased. The elasticity of the sling further has the advantage of automatically conforming to the particular shape of the user's underarm and acts as a shock absorber to prevent shocks from being transmitted to the user when the device impacts the ground.

The crutch in the embodiment of FIG. 16 is similar to the crutch of FIG. 10 with the exception of the arrangement of the spring attachment. Thus, like elements are identified by the same reference numbers with the addition of a prime. In this embodiment, the coil spring 115' extends from the bracket 120' to an arm 178 which is pivotally connected to the cross member 113' extending between the support rods 116'. As shown, the arm 178 is able to pivot from the position shown in FIG. 16 in the direction of arrow 180 to an opposite position so that the attachment point of the spring 115' to the cross member 113' is off-center with respect to the attachment point of the spring to the base 114'. This off-center attachment produces a normal position of base 114' being at an acute angle with respect to the vertical support rods 116' as shown in FIG. 16. In this manner, the base 114' will initially engage the ground at an angle and the weight of the user will cause the base 114' to pivot with respect to the support tubes 116' and fully contact the ground. The tension applied to the springs by the weight of the user will provide a shock dampening affect. The pivot arm 178 may be rotated in the direction of arrow 180 to reverse the angle of the base 114' with respect to the support rods 116' for right and left sides of the user's body.

Other arrangements may also be used to adjust the position of the spring attachment point on the cross member including, for example, a slide member or a plurality of holes spaced along the cross member. Alternatively, the spring may be attached to the cross member at a fixed point and the adjustment mechanism associated with the base or the bracket attaching the base to the support structure.

Figure 17:
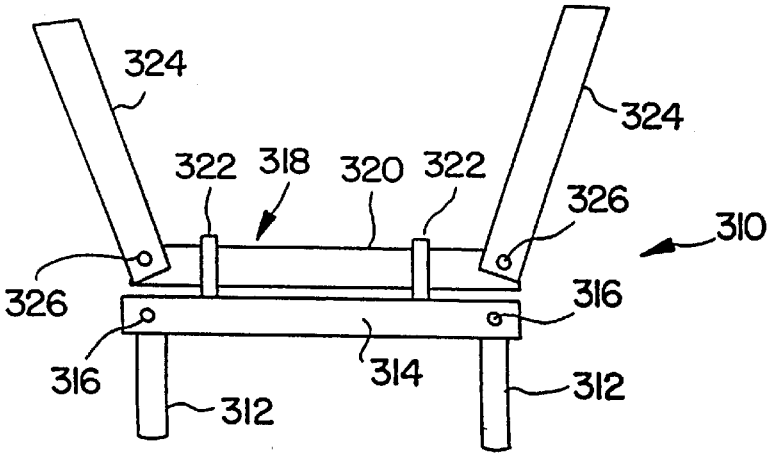
FIG. 17 is a partial side view of the crutch showing the underarm support with adjustable arms.

In further embodiments of the invention as shown in FIG. 17 the mobility assisting device 310 has a pair of vertical support rods 312 and a horizontal cross-bar 314 pivotally connected to the upper ends of the support rods 312. As in the previous embodiments, the cross-bar 314 is coupled to the support rods by a bolt or pin 316 to define the pivotal connection.

An underarm support 318 includes a horizontal bar 320 which is removably coupled to the horizontal cross-bar 314 by band clamps 322. In alternative embodiments, the horizontal bar 320 may be attached to the horizontal cross-bar 314 by bolts, pins, rivets or other suitable coupling means. A vertical rod 324 is pivotally connected to each end of the horizontal bar 320 by a bolt 326 as shown in FIG. 17 to define a pivotal connection. In this embodiment the angle of the vertical rods 324 may be independently adjusted to accommodate the particular needs of the user. The angle of the vertical rods 324 with respect to the horizontal bar 320 may be fixed by tightening the bolts 326 or other suitable coupling means. A resilient cushion material (not shown) is provided on the underarm support to increase the comfort to the user and permit the weight to be uniformly distributed.

Figure 18:
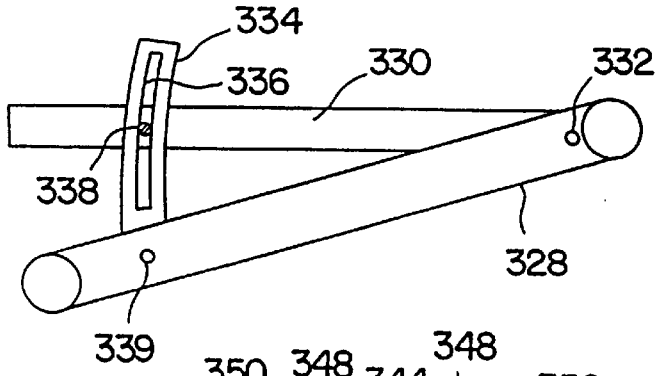
FIG. 18 is a top view of a further embodiment of the invention showing the angular adjustment of the underarm support.
Figure 19:
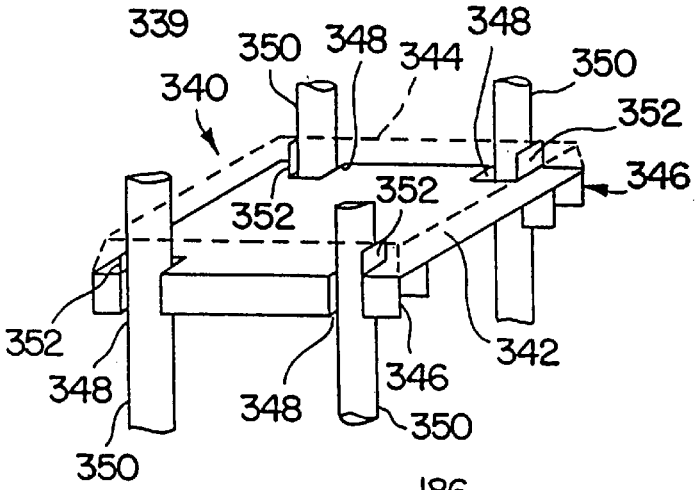
FIG. 19 is a perspective view of a leg support coupling a pair of crutch members together.

In a further embodiment shown in FIG. 18, the vertical support tubes are pivotally connected to a cross-bar 330 in a manner similar to the embodiment of FIG. 17. An underarm support 328 is coupled to the cross-bar 330 by a vertical pivot pin 332 so that the underarm support can pivot in a horizontal direction to the vertical support structure. The opposite end of the underarm support is coupled to the cross-bar 330 by an adjustable coupling plate 334 having an elongated slot 336 for receiving a screw 338 extending through the cross-bar 330. The coupling plate 334 is pivotally connected to the under-arm support 328 by a pin 339. The angle of the underarm support can be adjusted by loosening the screw 338, moving the underarm support to the selected location and then tightening the screw 338. If desired, the underarm support 328 can be adjusted to be parallel and aligned with the cross-bar 330.

An advantage of the mobility assisting device of the invention is the ability of the device to stand in an upright position without falling over. In a further embodiment shown in FIG. 19 a foot or leg rest may be removably attached to a pair of the devices. Often times a patient with an injured foot or leg is required to elevate the foot or leg during rest. An auxiliary foot rest 340 includes a planar support surface 342 and resilient cushion 344 shown in phantom lines. The foot rest 340 includes a pair of inverted channel members 346 coupled to the support surface 342. A pair of notches 348 are provided on opposite sides. In use, the notches 348 receive the vertical support rods 350 of the mobility assisting device while the channel members 346 receive the cross bars (not shown) extending between the vertical support rods. The notches 348 in the foot rest include upwardly extending flaps 352 to engage rods 350 and resist the pivotal movement of the vertical support rods.

Figure 20:
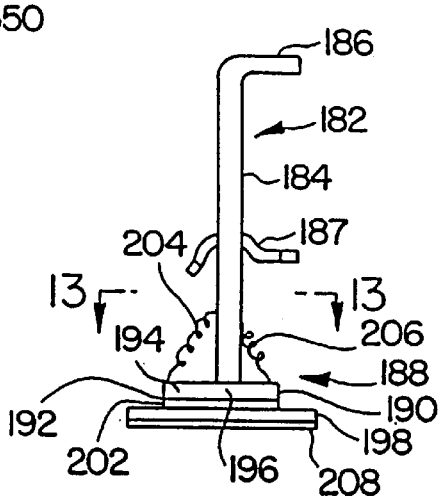
FIG. 20 is a side view of an alternative embodiment of the cane in accordance with the invention.
Figure 21:
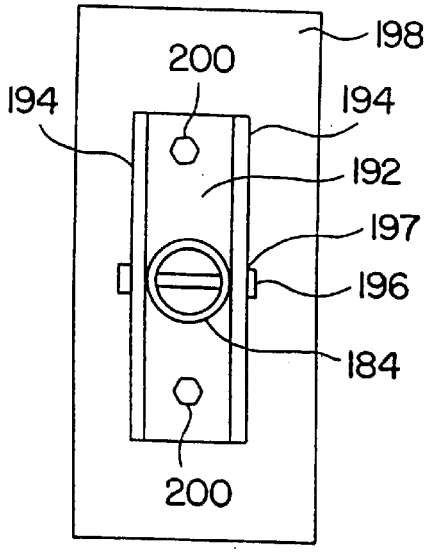
FIG. 21 is a partial cross-sectional view of the cane taken along line 18—18 of FIG. 17.
Figure 22:
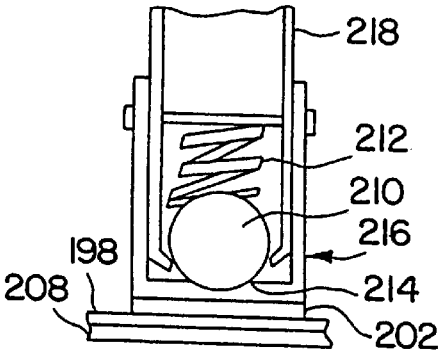
FIG. 22 is a partial cross-sectional view of a support structure showing spring biased ball and detent assembly.

A further embodiment of the invention shown in FIGS. 20–22 uses a base structure similar to the embodiment of FIG. 10 as a cane 182. The cane 182 includes a vertical rod 184 having a handle 186 at the upper end thereof. Alternatively, the handle may be a forearm crutch. The lower end of the rod 184 is pivotally coupled to the base assembly 188. The base assembly 188 includes a channel shaped bracket 190 having a bottom wall 192 and a pair of upright sidewalls 194. A bolt or pin 196 extends through aligned holes 197 in the sidewalls 194 and rod 184 to pivotally connect the rod 184 to the bracket 190 as shown in FIG. 21. The bracket 190 is coupled to a base plate 198 by a pair of bolts 200. A resilient cushion material 202 is positioned between the bracket 190 and base 198 to allow articulation of the bracket 190 with respect to the base 198 in a manner similar to the embodiment of FIG. 10. A pair of springs 204, 206 extend from the bracket 190 to the rod 184 to spring bias the base 198 to a perpendicular position with respect to the rod 184. A non-skid pad 208 is attached to the lower surface of the base 198.

In further embodiments, the cane assembly may include a pair of vertical support tubes pivotally coupled to the base in a manner similar to the crutch of FIG. 10. This arrangement provides increased stability compared to conventional crutches and enables the cane to stand in an upright position while the base is pivotable to maximize contact with the ground and increase traction.

In embodiments of the invention, the base 198 is dimensioned to enable the user to step on the base during use. In this manner, the base is easily moved forward with the foot of the user during walking. The width of the base can also enable the user to pick the cane up from the floor when it has fallen over by stepping on the base. A strap 187 shown in FIG. 20 may be included to secure the user's leg to the vertical support tube. The strap may be secured by a buckle, hook and pile type fastener or the like. Alternatively, a loop may be included on the base 118 and the toe of the user's shoe slipped into the loop.

In use, the cane 182 is used in a conventional manner. The springs 204, 206 preferably bias the base assembly 188 in a position perpendicular to the vertical rod. As the cane is carried forward by the user, the rear edge of the base assembly will first engage the ground and pivot with respect to the rod 184 until making full contact with the ground. The resulting tension on the springs provides a shock dampening affect and urges the rod 184 to a normal upright position.

The base assembly similar to that shown in FIG. 20 may also be constructed to accept a standard cane. In this embodiment the base assembly includes a coupling means to attach the standard cane to the base. The coupling means may be a hollow tube pivotally coupled to the base. A set screw or clamping arrangement is provided on the upper end of the hollow tube so that the cane tip is inserted into the tube and secured by tightening the set screw or clamping arrangement. This arrangement allows the user to modify their standard cane by removably coupling the cane tip to the pivotable base, thereby increasing surface area and traction. The hollow tube on the base assembly preferably has a pair of springs extending from the tube to the base to bias the tube and cane in the upright position similar to the embodiment of FIG. 20. The base assembly being attachable to a standard cane enables the cane to have increased traction, to be able to stand erect and be safer to use than standard canes.

The cane in further embodiments may include means to retain the rod 184 in an upright position with respect to the base. In the embodiment shown in FIG. 19, the retaining means is a ball 210 being biased downwardly by a spring 212 to engage recess 214 in the bracket 216. The spring 212 applies tension to the ball 210 to enable the vertical rod 218 to stand in a normal upright position and still pivot during use. Alternative devices can be used to retain the rod in an upright position such as, for example, a detent and recess arrangement in the rod and sidewall of bracket 216. In a further embodiment, the retaining means can be a locking arm pivotally connected to the base and releasably coupled to the vertical support rod.

Figure 23:
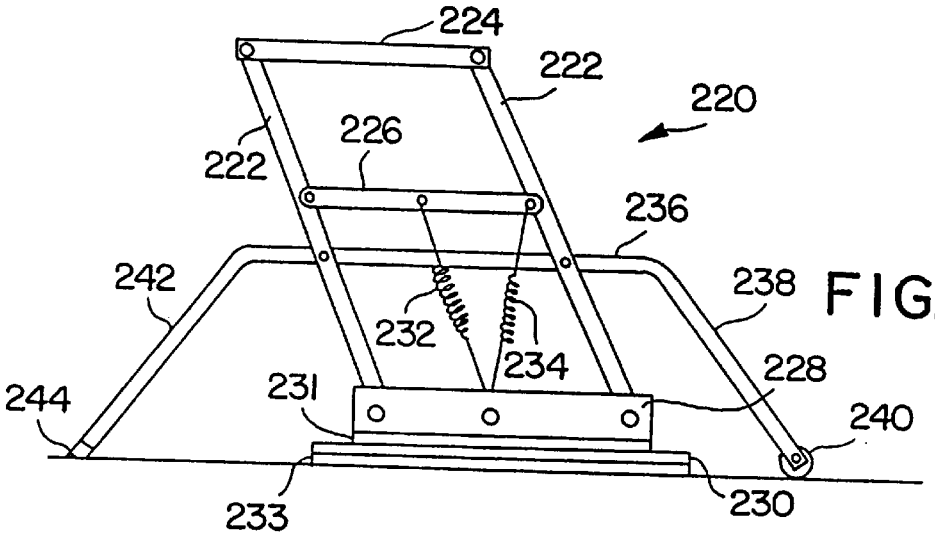
FIG. 23 is a side view of the walker device in accordance with a further embodiment of the invention.

The articulated vertical support can be used in a walker-type device as shown in FIG. 23 where each side of the walker 220 is a mirror image of the other and where the sides of the walker are coupled together by cross-bars substantially similar to the cross-bars shown in FIG. 6*a*. In a manner similar to the embodiment of FIG. 6, the support structure of the walker 220 forms a parallelogram having vertical support rods 222 pivotally coupled together at the upper ends thereof by a horizontal bar 224. An intermediate cross-bar 226 is pivotally coupled to rods 222 at about the midpoint of the rods 222. The lower ends of rods 222 are pivotally coupled to a U-shaped bracket 228 which is coupled to a base plate 230. A resilient rubber pad is positioned between the bracket 228 and base plate 230 to provide a shock dampening affect and allow articulated movement of the base plate 230 with respect to the support rods 222 as in the embodiment of FIG. 10. A resilient, non-skid pad 233 is attached to the bottom surface of base plate 230.

A first spring 232 extends from bracket 228 to a midpoint of intermediate cross-bar 226 to bias the support tubes in an upright position. A second spring 234 is also coupled to bracket 228 and extends to a leading edge of cross-bar 226. Preferably, spring 234 has sufficient tension to override spring 232 so that the walker assumes the configuration shown in FIG. 23 when at rest. In addition, the combination of springs 232, 234 initially requires minimum force to move the rods 222 to an upright position perpendicular to the base. As the rods 222 are pivoted past the perpendicular position the tension on both springs increase which helps prevent the rods from travelling too far forward.

A stabilizing bar 236 is attached to each side of the walker to prevent the walker from tipping forward or backward during use by limiting the pivotal movement of rods 222 with respect to base 230. The stabilizing bar 236 includes a horizontal section pivotally connected to each vertical rod 222. A leading inclined leg 238 extends from the leading end of bar 236. A roller 240 is attached to the lower end of leg 238. A trailing leg 242 extends at an incline from the trailing end of bar 238. A non-skid tip 244 is attached to the lower end of the leg 242.

In use, the walker assumes a normal rest position as shown in FIG. 23. The user grips each handrail 224 and walks forward so that the vertical rods 222 pivot forward with respect to the base 230. During the pivotal movement of rods 222, the legs 238, 242 lift from their ground engaging position of FIG. 23 and are carried forward in an arcuate motion until the legs again contact the ground. At this point, the springs 232 and 234 will be under tension. As the user lifts the walker, the base 230 will snap to assume the forward position as shown in FIG. 23.

The walker arrangement has the advantage that the handrails 224 move forward with the user while the base remains in contact with the floor. Furthermore, the arcuate movement of the handrail provides a stable forward travel and allows the user to take several steps at a time instead of the single step permitted with conventional walkers. When the user reaches the extent of the forward travel of the handrail, it is necessary only to lift the walker straight up allowing the base to move to the forward position by the springs. It is unnecessary for the user to carry the walker forward. In this manner, the walker functions similar to parallel rehabilitation bars rather than a conventional walker.

While the invention has been described in connection with what is presently considered to be preferred embodiments, it is to be understood that the invention is not limited to the disclosed embodiments, but is intended to cover various modifications and equivalent arrangements included within the spirit and scope of the appended claims.

What is claimed is:

1. A mobility assisting device comprising a pair of spaced apart support structures and means connecting said support structures together, each of said support structures comprising:

a substantially planar base;

a bracket coupled to said base, said bracket having a longitudinal dimension and a transverse dimension;

a resilient, shock dampening material disposed between said bracket and said base, whereby said bracket is pivotable in a transverse direction with respect to said base and said resilient shock dampening material biasing said bracket in a substantially upright vertical direction with respect to said base;

at least one vertical support coupled to said bracket and being pivotable in a longitudinal direction with respect to said bracket; and a hand grip attached to said at least one vertical support.

2. The mobility assisting device of claim 1, further comprising at least one spring for biasing said at least one vertical support to an upright position with respect to said base and bracket.

3. The mobility assisting device of claim 1, wherein said vertical support comprises first and second vertical support rods, each of said rods having a lower end coupled to said bracket and pivotable in a longitudinal direction with respect to said bracket.

4. The mobility assisting device of claim 3, further comprising a cross-bar having opposite ends thereof pivotally coupled to said first and second support rods;

a first spring coupled to a first point on said cross-bar and to a first point on said bracket for biasing said vertical support in an upright position; and a second spring coupled to a second point on said cross-bar spaced from said first point and coupled to said first point on said bracket to bias said vertical support to an acute angle with respect to said base in a normal rest position.

5. The mobility assisting device of claim 3, further comprising ground engaging stabilizing means coupled to said vertical support.

6. The mobility assisting device of claim 5, said stabilizing means comprising a forward extending leg pivotally coupled to one of said support rods for engaging the ground forward of said base; and a rearward extending leg pivotally coupled to the other of said support rods for engaging the ground rearward of said base.

7. The mobility assisting device of claim 6, further comprising a cross-bar pivotally coupled to each of said support rods, and said forward and rearward extending legs being coupled to said cross-bar.

8. The mobility assisting device of claim 1, wherein said bracket has a substantially U-shaped channel having first and second ends, wherein said vertical supports are pivotally coupled to said channel at said first and second ends.

9. A mobility assisting device comprising a pair of spaced apart support structures and means connecting said support structures together, each of said support structures comprising:

a substantially planar base;

a bracket coupled to said base, said bracket having a longitudinal dimension and a transverse dimension;

a resilient, shock dampening material disposed between said bracket and said base, whereby said bracket is pivotable in a transverse direction with respect to said base and said resilient shock dampening material biasing said bracket in a substantially upright vertical direction with respect to said base;

two spaced-apart vertical supports coupled to said bracket and being pivotable in a longitudinal direction with respect to said bracket; and a hand grip attached to each of said vertical supports.

10. The mobility assisting device of claim 9, further comprising a cross-bar spaced from said base and having opposite ends thereof pivotally coupled to said support rods;

a first spring coupled to a first point on said cross-bar and to a first point on said bracket for biasing said vertical support in an upright position; and a second spring coupled to a second point on said cross-bar spaced from said first point and coupled to said first point on said bracket to bias said vertical support to an acute angle with respect to said base in a normal rest position.

* * * * *